United States Patent [19]

Rovin

[11] Patent Number: 4,515,097

[45] Date of Patent: May 7, 1985

[54] DRAPERY PLEAT HEMMING METHOD

[76] Inventor: Herman Rovin, c/o Automatech Industries Inc., Rte. 3 Box 370A, Piedmont, S.C. 29673

[21] Appl. No.: 412,553

[22] Filed: Aug. 30, 1982

[51] Int. Cl.[3] ..... D05B 97/00; D05B 35/08; D05B 3/02

[52] U.S. Cl. ..... 112/262.3; 112/121.14; 112/134

[58] Field of Search ..... 112/262.3, 262.1, 134, 112/135, 132, 121.14; 223/30, 31, 32

[56] References Cited

U.S. PATENT DOCUMENTS

| | | | |
|---|---|---|---|
| 3,661,103 | 5/1972 | Firestein et al. | 112/134 |
| 3,760,746 | 9/1973 | Portilla, Jr. | 112/134 |
| 3,824,964 | 7/1974 | Ryan | 112/134 X |
| 3,862,610 | 1/1975 | Brocklehurst | 112/121.14 X |
| 3,874,311 | 4/1975 | Kenney | 112/121.14 |
| 4,073,246 | 2/1978 | Crawford et al. | 112/134 X |
| 4,079,682 | 3/1978 | Nishiwaki | 112/134 |

*Primary Examiner*—H. Hampton Hunter
*Attorney, Agent, or Firm*—Mandeville and Schweitzer

[57] ABSTRACT

The disclosure is directed to method and apparatus for automatically forming and sewing pleats in draperies and the like. Conveyor feeding of the fabric margin is provided for. A rotatable indexing drum, with a plurality of pleating stations, engages the fabric in successive spaced area and forms the desired pleats. A displacement element acts on the fabric between pleat-forming stations of the drum for uniform, controllably variable pleat spacing. The formed pleats, while gripped by the pleat-forming drum, are advanced to a sewing station, where the sewing machine and a related fabric clamp function as manipulating jaws to engage and remove the pleat, which is thereafter held by the clamp while the pleat is stitched. A unique form of clamp allows the sewing machine to be in continuous motion during the stitching operation, while the fabric is held substantially stationary. The system provides for automatic centering of the pleats, regardless of minor variations in fabric width, as well as expeditious stitching along the end runs. Operator involvement is limited to loading of the fabric onto the in-feed conveyor and removing the finished article after completion of the pleating operations. A single operator can easily service two machines operating at a relatively high rate of speed.

5 Claims, 27 Drawing Figures

FIG.9
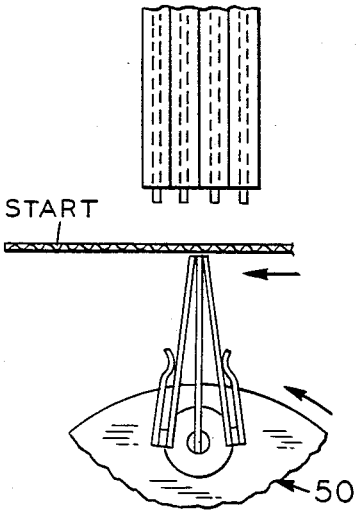
FIG.10
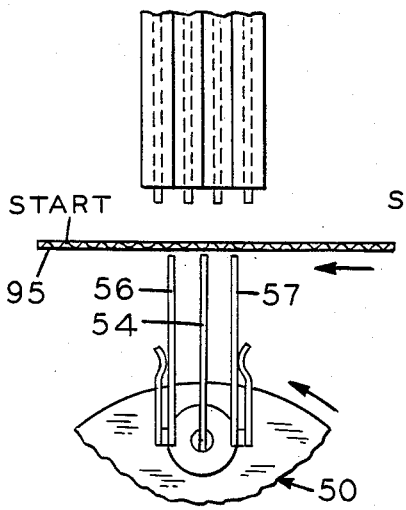
FIG.11
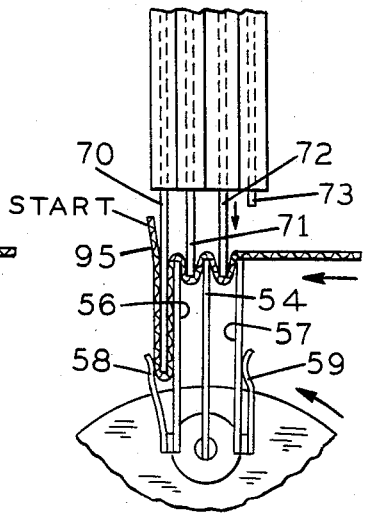
FIG.12
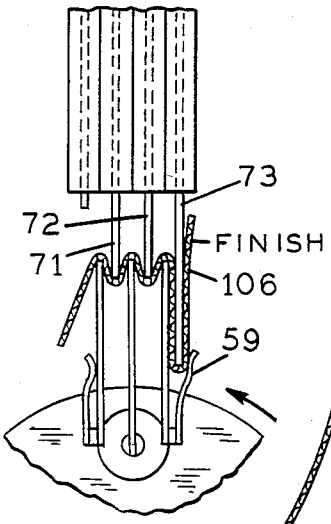
FIG.13
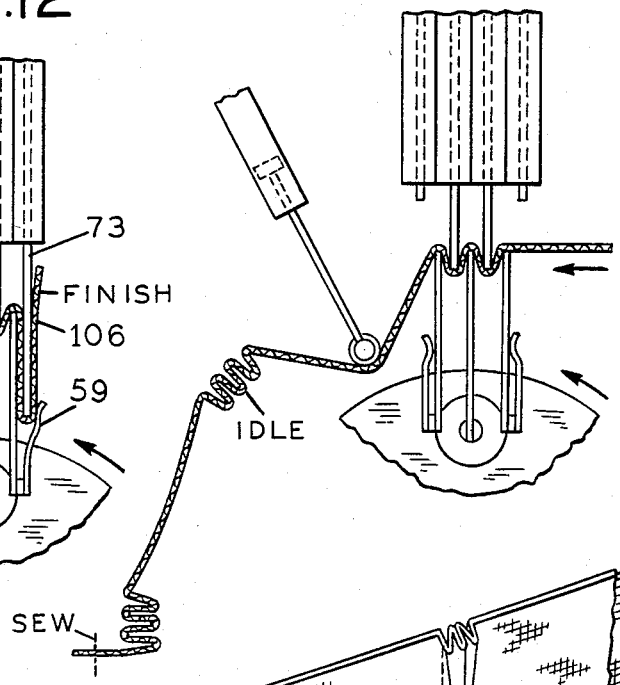
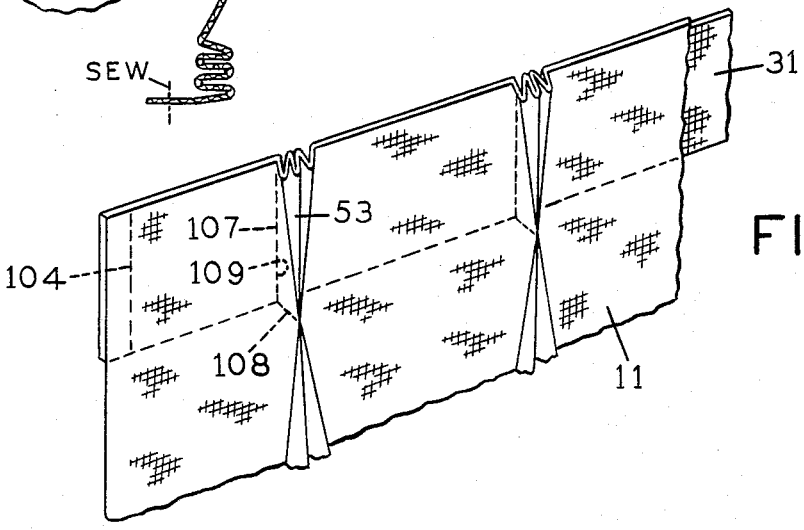
FIG.8

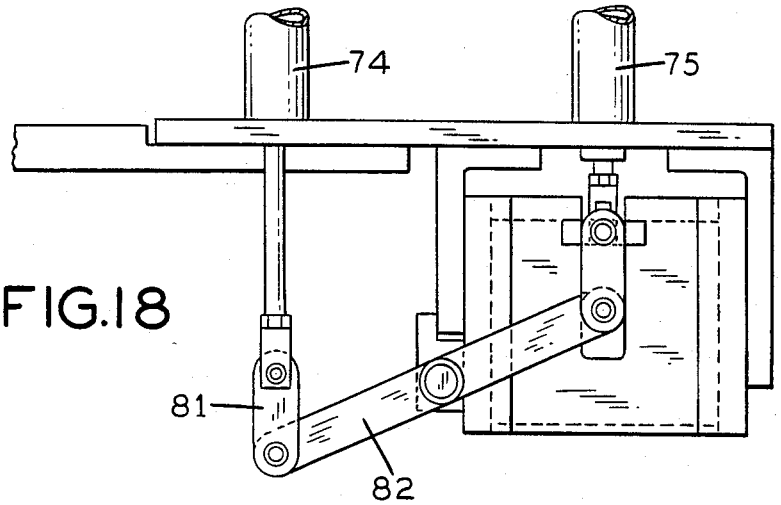
FIG.18
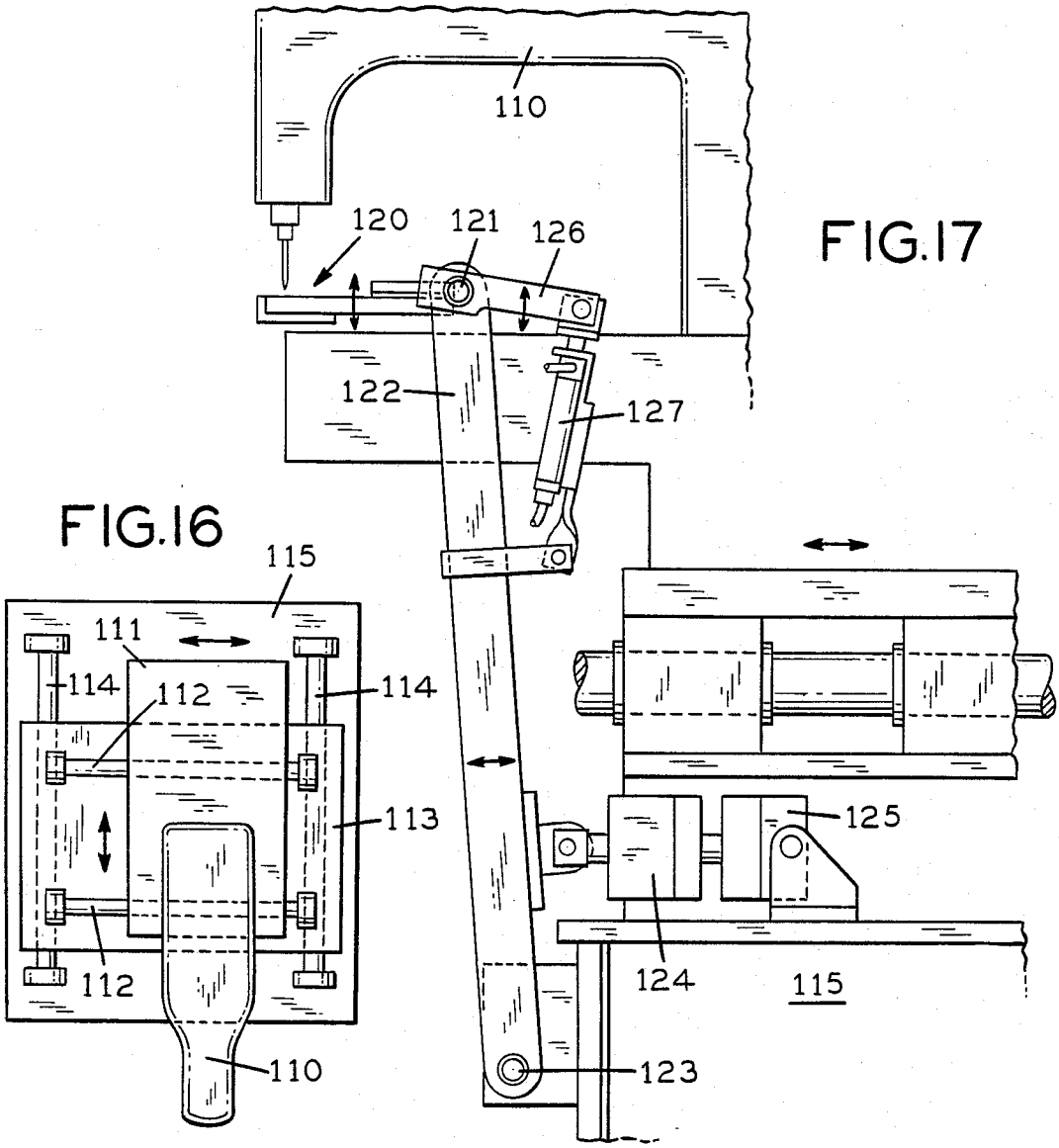
FIG.17
FIG.16

FIG.19
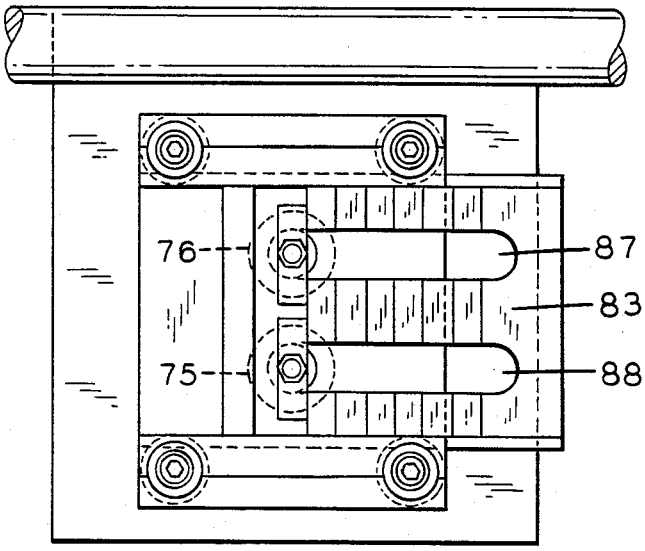
FIG.22
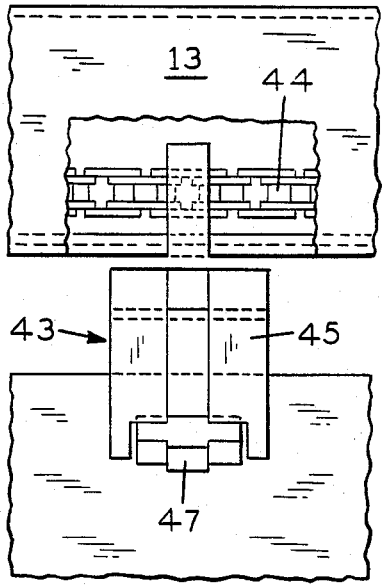
FIG.20
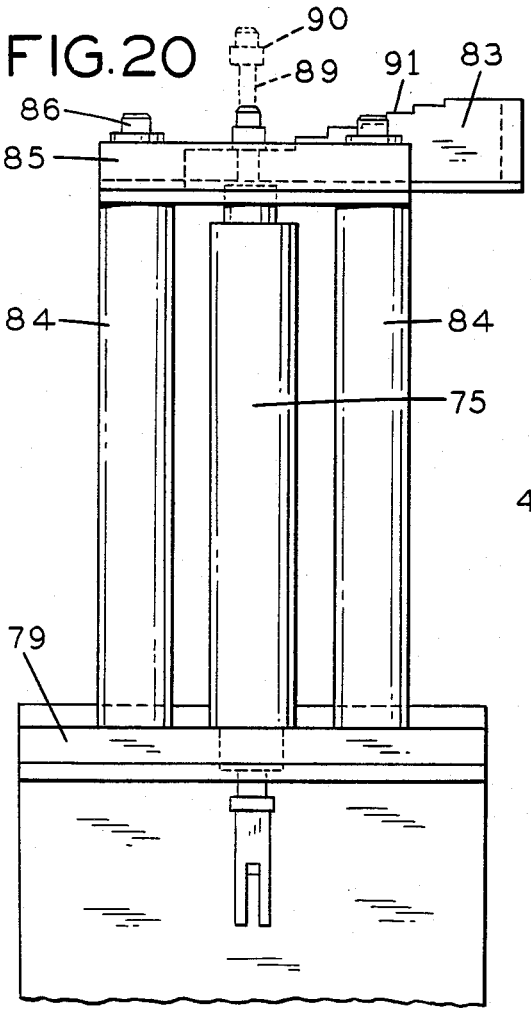
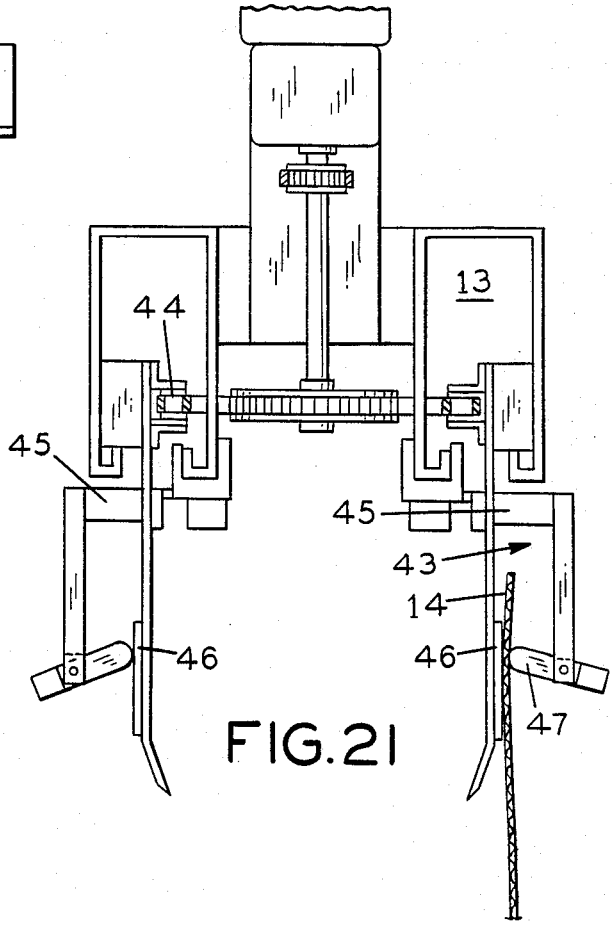
FIG.21

FIG.23
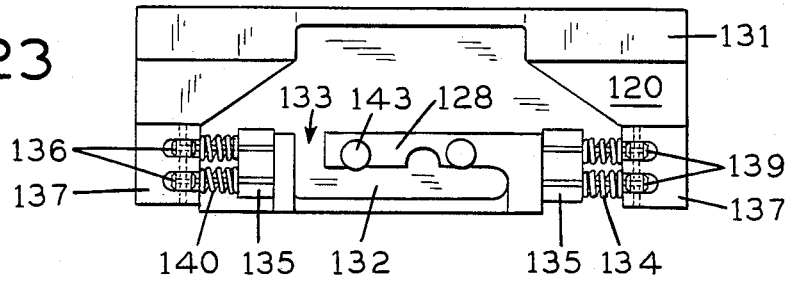
FIG.24
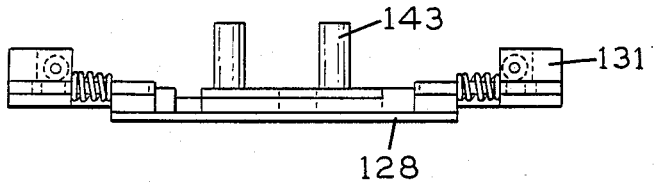
FIG.25
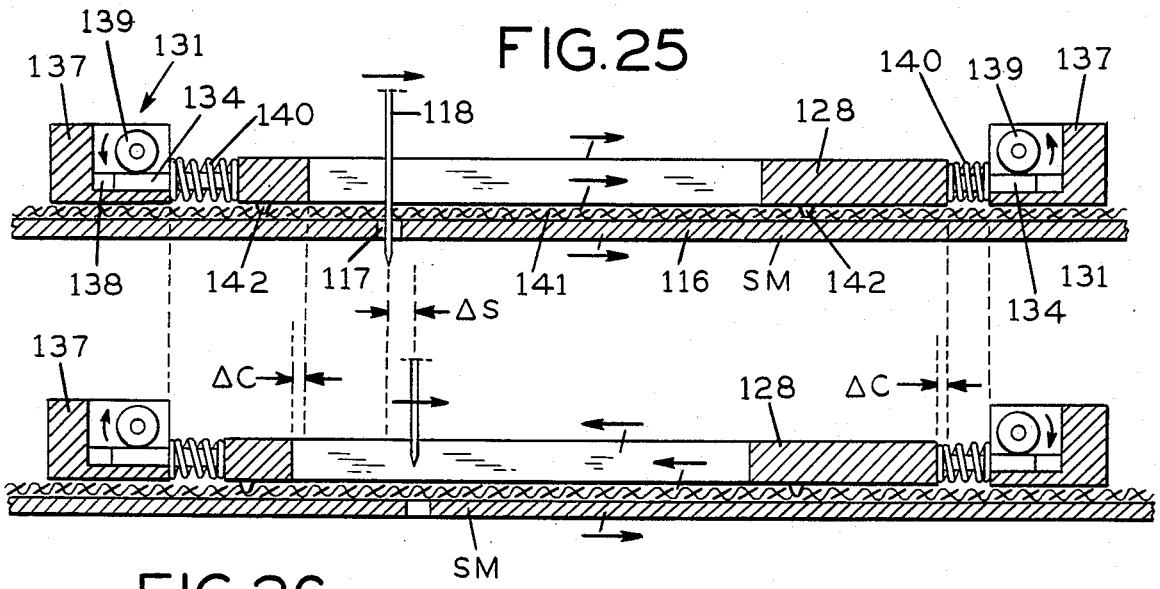
FIG.26
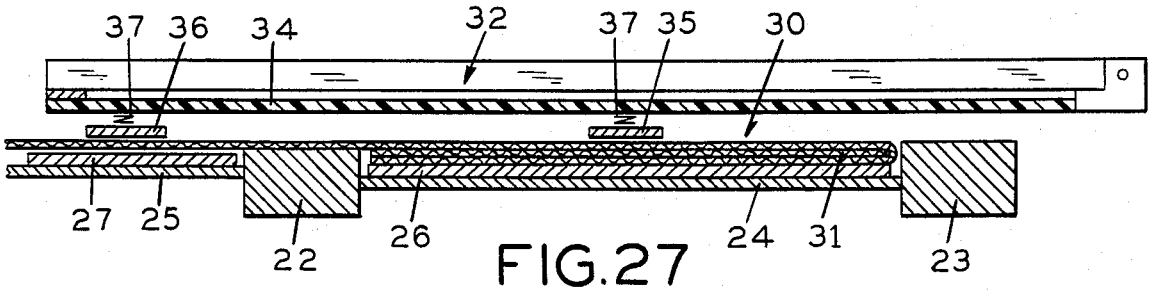
FIG.27

DRAPERY PLEAT HEMMING METHOD

BACKGROUND AND SUMMARY OF THE INVENTION

In the manufacture of ready-to-use draperies, drapery sections frequently are formed at a standard width, known as a "five pleat equivalent", which includes five pleats formed along the upper margin of the drapery fabric, with short end runs extending beyond the pleats nearest the fabric edges. Generally, if greater widths are desired, two or more standard sections of the five pleat equivalent width may be stitched together. This particular production technique is, of course, not critical to, nor is it a limitation of, the present invention, but is merely illustrative of typical commercial practice.

Usually, the fabric section is hemmed along the bottom and opposite side edges prior to the pleating operation. The upper edge, along which the pleats are to be formed, is provided with stiffening, typically by the securement along the upper edge extremity of a narrow strip of buckram, for example. In preparation for the pleating operation, the buckram is folded against the back surface of the fabric, and the fabric advantageously is turned over the buckram to provide a finished upper edge. Typically, the buckram strip may be of somewhat greater length than the width of the unpleated fabric, in which case the end extremities of the buckram are folded back prior to the folding over of the upper margin of fabric.

The usual operations involved in pleating of the stiffened fabric edge include forming a short "vertical" line of closing stitches adjacent each edge of the fabric (the term "vertical", as used in this context, referring to the orientation in which the drapery fabric normally is to be hung). At various uniformly spaced locations along the stiffened upper margin of the fabric, the fabric is gathered into a short accordion fold pleat, which may be 3–4 inches in height. This is secured by stitching, either in the form of an "L" tack or in the form of an inverted "F" tack, rendering generally permanent the formed pleats.

In the forming of pleats for drapery fabrics and the like, it is known to use a plurality of opposed tucking blades, typically three on the backside of the fabric, opposed by two on the front side. The fabric is first laid over the three blades at the backside, which are spaced apart far enough to receive between adjacent ones, a blade from the opposite side, together with the necessary thicknesses of fabric. While one side, usually the leading side, is held stationary, a single blade from the front side (referred to as a sizing blade) enters between a pair of blades located behind the fabric, penetrating to a predetermined depth and carrying fabric with it to form a first pleat fold. Next, while the first sizing blade retains its position, a second sizing blade enters from the front side, penetrating between and carrying fabric down into the space formed by the next adjacent pair of blades positioned behind the fabric. This forms the second pleat fold. Typically, the sizing blades may be retracted, permitting the formed pleat to be gripped and retained exclusively by the rear blades. There is then initiated a relative movement between the newly formed pleat and a sewing machine, such that the pleat is brought into position to be secured by sewing. Typically, the stitching includes at least a vertical stitch line, at the base of the pleat, and a horizontal stitch extending out to the front edge of the pleat. This allows the pleat folds to open and fan upwardly and outwardly from the L-shaped stitching. Frequently, it is desirable to include a second, short horizontal stitch partway between the base of the "L" and the top extremity of the fabric, such that the center accordion fold is at least lightly tacked and prevented from reversing and folding outward.

In general, the above described operations have been known and have been sought to be performed on an automatic or semiautomatic basis. Nevertheless, insofar as the applicant is aware, drapery manufacturing operations as practiced at the present time involve excessive amounts of hand labor, because of the substantial difficulties involved in more fully operating the manipulating and sewing operations required to be performed, in order to achieve a product of first class saleable quality.

Pursuant to one aspect of the invention, a novel, highly automated method and apparatus is provided for the production of pleated drapery fabrics, in which the production operations are substantially fully automated following the initial loading of the fabric onto an in-feed conveyor. In this respect, certain of the features of novelty reside in the conveyor itself, and include an improved arrangement for receiving, holding and conveying the stiffened upper edge margin of the fabric, which has been first properly folded by the operator before being loaded into the conveyor system.

Bearing in mind that successive pieces of fabric, although nominally of identical size, have measurable and sometimes significant variations in overall width, the arrangement of the invention provides for the automatic accommodation of and adjustment to such width variations. To this end, the in-feed conveyor includes a loading section having measuring calibrations at each end. When the operator loads a fabric section into the conveyor, he or she locates the fabric symmetrically with respect to the calibrations at each side, assuring that the fabric section is properly "centered" by the control facility. In addition, an edge guide may be brought over against the trailing edge, serving automatically to measure the width of the fabric and establish certain operating parameters related thereto. This arrangement enables the center pleat to be reliably centered on the fabric piece, regardless of width variations, and also enables a high degree of uniformity to be realized in the end runs of the fabric, by adjusting for width variations in the overall fabric. The latter control is achieved by incrementally varying the space between adjacent pleats sufficiently to accommodate in an unobtrusive way small variations in overall fabric width.

In accordance with another significant aspect of the invention, a series of pleating operations are effectively and efficiently carried out without manual intervention, by means of a novel and improved rotary drum-like device, having a plurality of pleat-forming stations which successively engage the fabric, effect the pleat formation in a partially known manner by the interweaving of pleatforming blades from opposite sides of the fabric, and then conveying the fabric via periodic rotational indexing motion of the drum-like device to a convenient position for effecting the sewing operation. In conjunction with a multiple position pleat-forming drum, there is provided an adjustable stroke fabric displacement element, engageable with the fabric in the area between a just-formed pleat and a pleat about to be formed. By extending the displacement element to the adjusted limit of its stroke, between pleat-forming operations, a predetermined length of fabric is displaced from a straight line path from one pleat-forming station to another, while the fabric is maintained under light tension. By this means, the length of fabric between pleats may be precisely and uniformly controlled, and accurately adjusted for various operating conditions, in order to achieve optimum symmetry in the finished article.

At the sewing position, the sewing machine and a related fabric clamping mechanism are used in a novel, cooperative arrangement to provide a pleat gripping and transport mechanism, engageable with the unsewn fabric pleat to withdraw it from the pleat-forming mechanism and transfer it to an appropriate location for completing the sewing operation. Among other things, the blades of the pleatforming device are slotted to receive the sewing machine needle and allow the needle to be withdrawn radially with respect to the pleat-forming drum. The sewing machine itself is controlled to be moved into engagement with the fabric, and the needle lowered to pass through the fabric, but not be retracted. With the newly formed pleat being engaged between the sewing plate and the fabric clamp, and the fabric also being positively engaged by the passed-through needle, the sewing machine and clamp can be synchronously withdrawn from the pleatforming drum, to effect release of the fabric therefrom and bring it, while being held in pleated condition by the clamp, to a more appropriate location for sewing.

As a specific but advantageous feature of the invention, a novel form of clamp is provided, which enables the fabric to be held in a generally fixed position for sewing, while the sewing machine itself and the sewing plate supporting the fabric, are moved through the necessary excursions to effect the desired L-shaped or F-shaped tack stitch. To this end, the clamp is mounted to accommodate a limited, one stitch length movement in any direction, so that the fabric and clamp may move along with the constantly laterally moving sewing needle during the times when the needle has penetrated the fabric. When the needle is withdrawn, the fabric and clamp return to their "normal" positions in preparation for execution of the next stitch. This arrangement enables the stitching operation to be performed at extremely high speeds, without unduly stressing the needle or the fabric.

Another particularly advantageous feature of the present invention resides in a novel arrangement of indexing a pleat-forming element, in the specific example a rotary drum, which functions with additional, selectively operable fold-forming blades projectable from the front side of the fabric, to shape and form the end runs of the fabric, to enable the end runs to be properly and efficiently tacked by the sewing machine both prior to the sewing of the first pleat and following the sewing of the last pleat, all without the necessity of operator intervention.

For a more complete understanding of the above and other features and advantages of the invention, reference should be made to the following detailed description of a preferred embodiment and to the accompanying drawings. It will be particularly understood that the variods described features of the invention may in many cases be utilized independently of one another, and it should not be assumed that any or all of the inventive features need be utilized in combination, except as otherwise set forth in the hereinafter appended claims.

DESCRIPTION OF THE DRAWINGS

FIG. 8 is a fragmentary perspective illustration of a section of fabric provided with a pleated upper margin as contemplated by the invention.

FIGS. 9, 10 and 11 are simplified sequential views illustrating some of the steps involved in the formation of a pleat, in conjunction with the leading end run of the fabric section.

FIG. 12 is a schematic illustration showing the formation of a pleat in conjunction with the finish end run of the fabric.

FIG. 13 is a simplified illustration of the formation of an intermediate pleat, illustrating the use of a controlled displacement device for effecting adjustable spacing of adjacent pleats.

FIG. 16 is a simplified, schematic top plan view illustrating mounting of the sewing machine used in securing of the formed pleats.

FIG. 17 is a simplified illustration of the sewing machine and fabric clamp mechanism associate therewith, for retaining the pleated fabric during sewing operations.

FIG. 18 is a fragmentary illustration of mechanisms used in the actuation of pleat-forming plates, utilized to tuck folds of fabric between sets of pleat holding plates, in the pleat-forming operation.

FIGS. 19, 20 are fragmentary top plan and side elevational views respectively, illustrating a simplified control device utilized in adjusting the actuating stroke of the pleat-forming plates, to determine the depth of the pleats to be formed.

FIG. 21 is a fragmentary cross sectional view illustrating details of a fabric conveyor mechanism, for conveying the bottom edge of a fabric section during pleat-forming operations.

FIG. 22 is an enlarged, fragmentary elevational view of a simplified fabric engaging clamp utilized in the conveyor of FIG. 21.

FIGS. 23, 24 are fragmentary top plan and front elevational views respectively of a novel form of fabric engaging clamp utilized in the apparatus of the invention.

FIGS. 25, 26 are enlarged cross sectional views of the clamp of FIGS. 23, 24, illustrating the manner in which the clamp functions during sewing operations.

FIG. 27 is an enlarged cross sectional view, as taken generally along line 27—27 of FIG. 6, showing details of the hem conveying mechanism used in the apparatus of the invention.

DESCRIPTION OF A PREFERRED EMBODIMENT

Figures 1, 2:
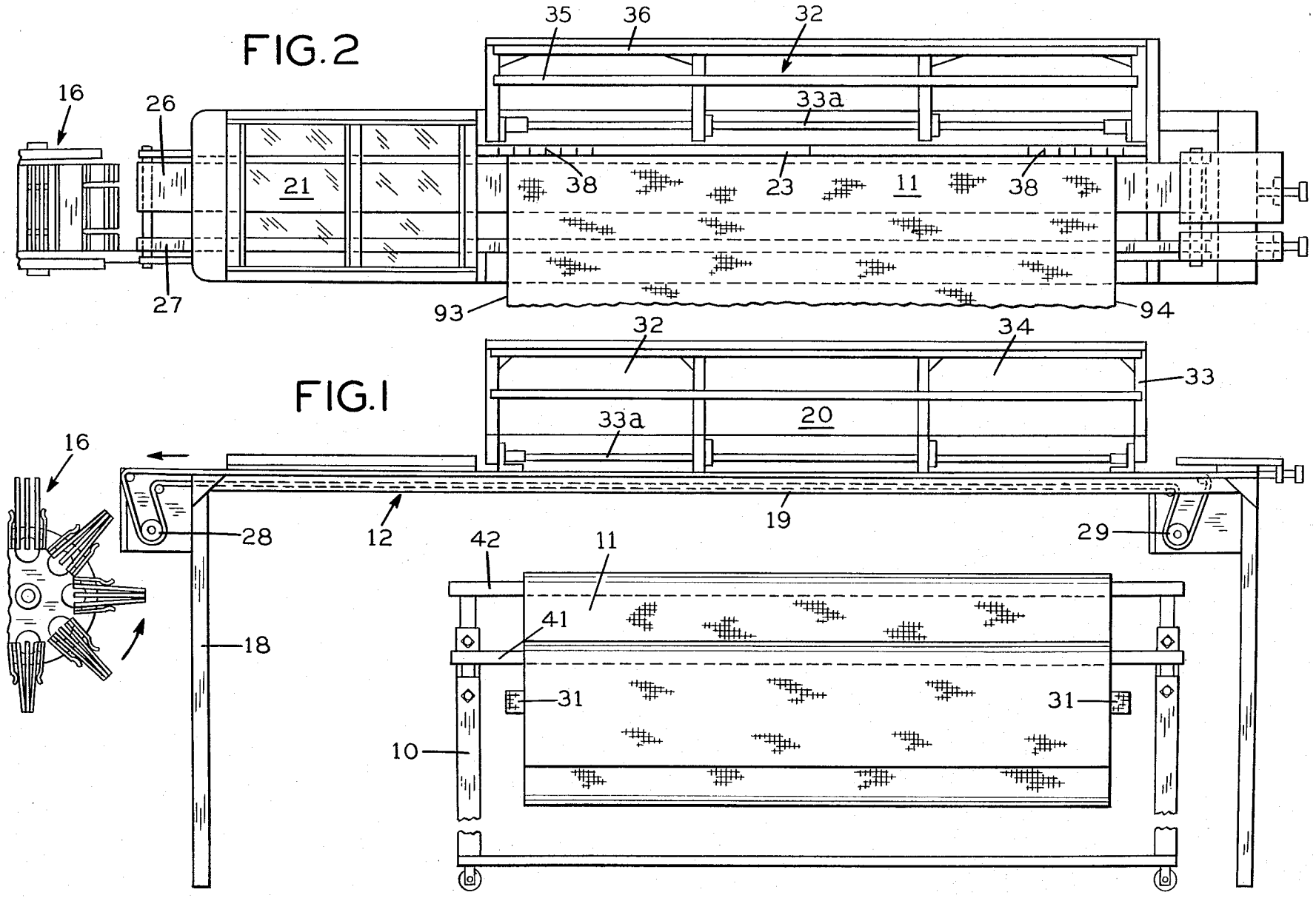
FIGS. 1 and 2 are front elevational and top plan views respectively of a fabric pleating apparatus incorporating features of the invention.
Figure 4:
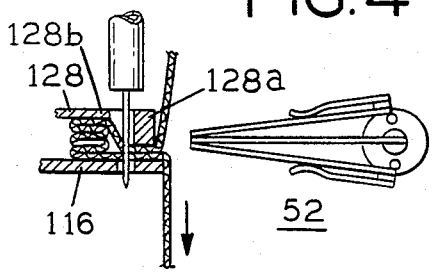
FIG. 4 is a fragmentary illustration of the mechanism of FIG. 3, shown after the fabric has been withdrawn from the pleat-forming mechanism, leaving the formed pleat retained in the sewing machine.

Referring now to the drawings, and initially to FIGS. 1–5 thereof, the reference numeral 10 designates generally a rack on which rests a stack of fabric sections 11 awaiting to be pleated and sewn. In normal operation, the rack 10 is positioned underneath a conveyor system, generally designated by the numeral 12, for advancing an upper edge of a fabric section for pleating and hemming. An auxiliary conveyor mechanism, generally designated by the reference numeral 13 (see FIG. 5) is engageable with the upper edge 14 of a fabric section 11, for conveying the "lower" edge of the fabric along with the upper edge, during the processing of the latter.

In a general sense, in the operation of the illustrated equipment, a fabric section 11 is loaded into the primary and secondary conveyors 12, 13, and advanced to a pleating station, designated generally by the numeral 16. At the pleating station, the "upper" margin of the fabric section is controllably gathered into pleats and conveyed to a sewing station, generally designated by the reference numeral 17, where the pleats are secured. In a typical production operation, the fabric section 11 is a so-called five pleat equivalent, which is of a length appropriate for the formation of five spaced pleats, together with short end sections extending beyond the first and last pleats. These short end sections are also hemmed at the sewing station 17, in the process of the invention.

After completion of the pleating and sewing operations, the fabric section 11 will be engaged exclusively by its "lower" margin and suspended upside down by the secondary conveyor 13. At this juncture, the fabric is released by the machine operator from the secondary conveyor and placed in a suitable rack (not shown) for finished pieces.

The system includes numerous features of novelty, including aspects of the conveyor system, for conveniently and positively controlling the "upper" margin of the fabric section during the pleating operations, unique arrangements for effecting the pleat-forming operations themselves, as well as handling of the fabric section in the area of the end runs, adjacent the first and last pleats, and also the facilities for effecting the sewing of the pleats in an optimal, high speed manner.

Figure 6:
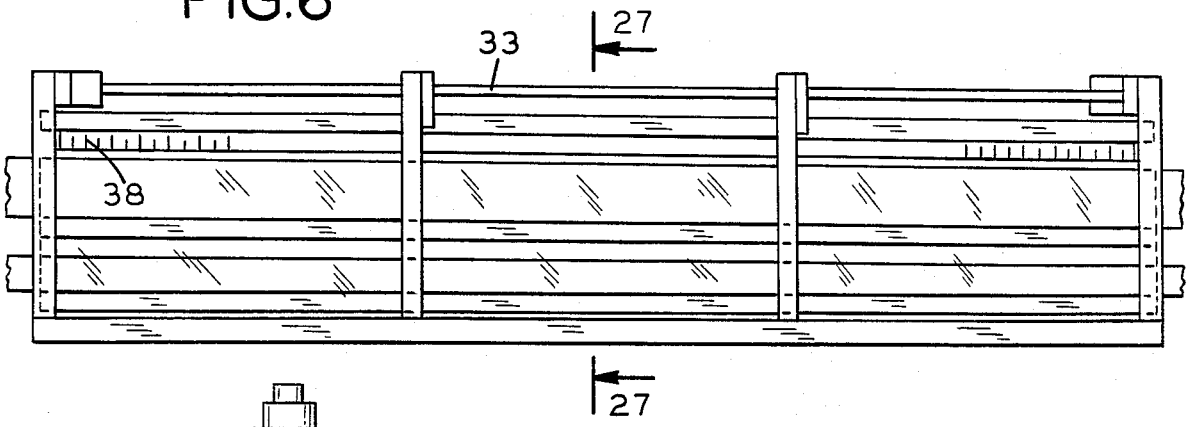
FIG. 6 is an enlarged, fragmentary top plan view, illustrating a portion of the conveyor table for engaging and advancing the fabric margin to be pleated.
Figure 5:
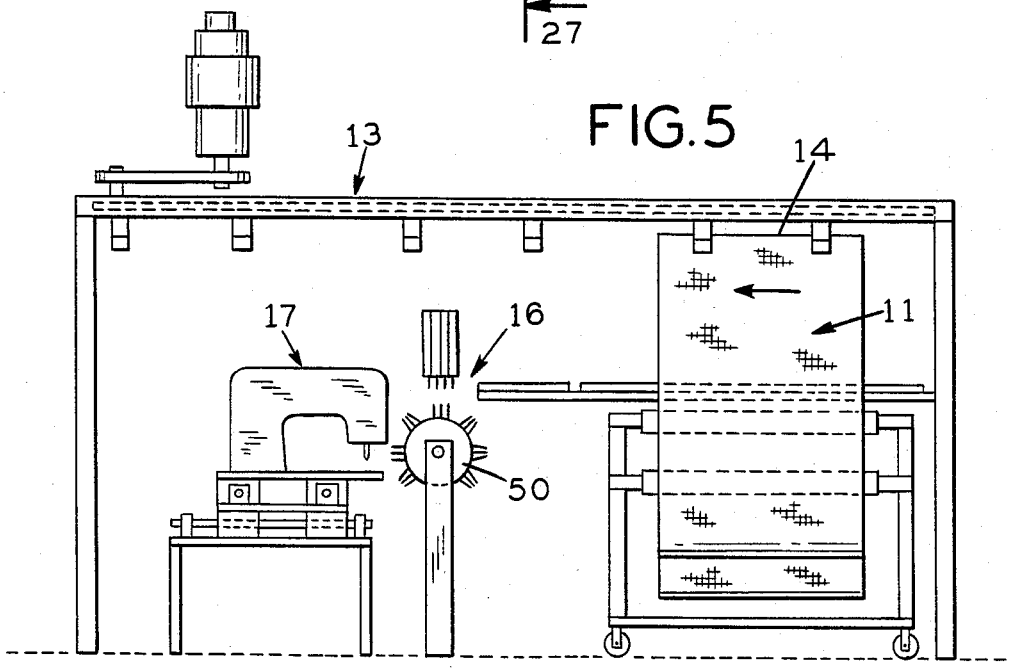
FIG. 5 is a front elevational view illustrating the pleat-forming equipment of the invention as used in conjunction with related conveyor equipment for handling fabric sections during the pleat-forming operations.

In the illustrated form of the invention, the primary conveyor system, illustrated particularly in FIGS. 1, 2 and 6, includes a frame structure 18, forming a horizontal conveyor table 19. The conveyor 12 includes a loading section 20, and delivery section 21. The loading section 20 is arranged for the convenient reception of unprocessed fabric sections, and the delivery section 21, adjacent the loading section in the downstream direction of belt movement, is arranged to deliver the fabric controllably to the pleating station 16.

As reflected in the cross sectional view of FIG. 27, the conveyor table 19 includes spaced guide bars 22, 23 between which extends a support plate 24. A similar support plate 25 extends on the opposite side of the guide bar 22. Movably supported on the plates 24, 25 are conveyor belts 26, 27, which are trained about common guide rollers, for example the guide rollers 28, 29, and are of course driven at synchronous speeds.

As reflected in FIG. 27, the spacing between the guide bars 22, 23 closely approximates the width of the upper hem section 30 of the piece of fabric, the upper hem being the portion intended to be pleated.

Figure 7:
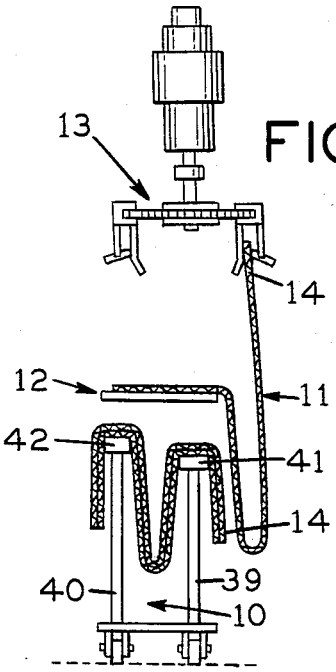
FIG. 7 is an end elevational view, illustrating the manner in which a section of fabric is handled by the conveying equipment during a pleat-forming operation.

In a typical drapery pleating operation, the upper marginal extremity of the fabric has attached thereto a narrow strip 31 of buckram, which serves as a stiffening material. Typically, the buckram strip is slightly longer than the width of the fabric section 11, as reflected in FIG. 1. When the operator prepares to load a fabric section 11 into the primary conveyor, the buckram strip 31 is first folded-over against the back face of the fabric, and then the fabric itself is folded over the buckram, forming a three layer pleatable margin, as reflected in FIG. 7. Conventially, the extended end portions 31 of the buckram stiffening strip are folded back, prior to the last fold-over of the fabric, so that the raw buckram material is not exposed at the end extremities of the pleated margin.

After folding and forming of the pleatable margin, it is placed into the shallow channel defined by the guide strips 22, 23 and the primary conveyor belt 26 (see FIG. 27). Adjacent portions of the fabric overlie the secondary conveyor belt 27 and are arranged to be transported by it, in synchronism with the main belt 26.

A retaining cover 32 is pivotally secured to the back edge of the primary conveyor 12, as be means of a hinge bar 33*a*. Desirably, the cover 32 is constructed of a skeletal frame 33 and transparent panel means 34, formed of safety glass or transparent plastic. In addition, longitudinally extending confining strips 35, 36 are mounted underneath the cover, by means of light compression springs 37, by means of which the strips 35, 36 press lightly downwardly upon the fabric material, in regions above the respective conveyor belts 26, 27. Thus, in order to effect preliminary loading of the section to be pleated, the cover 32 is first pivoted upwardly to an open position to provide loading access. The fabric section, with the buckram ends and the fabric upper margin properly folded, is laid on the respective conveyor belt sections 26, 27, with the margin to be pleated confined between the guide strips 22, 23. When the fabric has been thus properly positioned, the cover is closed such that, for practical purposes, the fabric is rather positively confined on the conveyor for effective, controlled delivery to the pleating station. When the conveyor belts are actuated, the fabric is conveyed controllably toward the left, as viewed in FIGS. 1 and 2, passing from the loading section 20, through the delivery section 21 and being thus delivered to the pleating station 16.

Taking into consideration the inevitability of minor width variations in the fabric sections 11, the rear guide strip 23 is provided with a series of calibrations 38 in the vicinity of the side edges of the fabric. When the operator places the fabric onto the conveyor, care is taken to center the fabric section with respect to the calibrations 38. In addition, by means not shown herein, the location of one of the fabric side edges can be detected by a control device, and by this means it is assured, first, that the pleats are symmetrically positioned along the upper margin of the drapery fabric and, second, that the spacing between successive pleats is such as to provide for end runs of appropriate size and uniformity.

To advantage, the rack 10, containing the supplies of unprocesseed fabric sections, is of a size and shape to be received directly underneath the primary conveyor 12, whereby an operator can easily grasp the "upper" edge of the fabric section, perform the necessary folding operations thereon and conveniently place the folded section onto the conveyor. In the illustrated arrangement, the support 10, which is mounted on wheels for convenient positioning, comprises spaced pairs of front and back frame elements 39, 40, supporting between them horizontal frame bars 41, 42. As reflected in FIG. 7, the fabric is draped over the respective frame bars 41, 42, with the "upper" edge of the fabric draped over the rear bar 42, the "lower" edge draped over the front bar 41, and a considerable length of the fabric draped downwardly in between. As reflected in the schematic illustration of FIGS. 5 and 7, after the upper edge of the fabric section has been properly folded and laid onto the primary conveyor 12, the "lower" edge 14 of the same fabric section is gripped by the operator and lifted up into engagement by the secondary conveyor 13. These two conveyors are driven to operate in a predetermined relationship so that the "lower" edge generally follows the progress of the "upper" edge during the pleat-forming and sewing operations.

The upper or secondary conveyor 13 is provided with simple, quick-acting fabric suspension elements 43, as shown in FIGS. 21, 22. A driven conveyor chain 44 mounts suspension brackets 45, each consisting of a backup plate 46 and a weight-actuated, pivoted gripping lever 47. By action of gravity, the levers 47 tend to assume an upwardly tilted, near-horizontal position, contacting the back plates 46. To load the bottom fabric edge 14 onto the upper conveyor, is merely necessary to slip the fabric edge upwardly between the backing plate 46 and the locking lever 47, the latter easily tilting upward to allow entry of the fabric. By action of gravity, however, the lever 47 locks the fabric in suspended relation, as reflected in FIG. 21. Release, is, of course, easily accomplished by simply tipping the lever 47 upward. Generally, it is sufficient to retain the fabric section by means of two of the conveyor clip assemblies 43, substantially in the manner reflected in FIG. 5. Overall, the arrangement of the primary and secondary conveyors is such as to accommodate swift, simple, reliable loading of the equipment, using ordinary machine operators, requiring no special or high level skills.

In accordance with a significant aspect of the invention, a unique and advantageous pleat-forming mechanism is provided, which is in position to receive the delivered fabric, form and space the pleats, and position the end runs of the fabric for hemming. As shown particularly in FIG. 3, the pleat-forming mechanism includes an indexable drum 50 mounted by means of a shaft 51 for rotation adjacent the delivery end of the primary conveyor 12. In the illustrated arrangement, the indexable pleating drum is provided with eight independent pleating stations generally designated by the reference numerals 52, which extend in a generally radial direction from uniformly spaced positions about the drum. The number of pleating stations is not critical, although eight appears to be a rather optimal number for convenience of configuring the apparatus and carrying out the various required operations thereon.

The illustrated form of the invention is designed for the production of pleated fabrics having a triple pleat fold 53 (see FIG. 8). To this end, the several pleat-forming stations 52 each consist of a central, radially directed, fixed plate 54, mounted at each side in spaced drum forming discs 55. On opposite sides of the central plate 54 are first and second gripping plates 56, 57 mounted in the drum for limited pivotal movement and urged by springs (not specifically shown) yieldably toward the central plate 54. The arrangement is such that the series of plates 54, 56, 57, when free of fabric and not forcibly separated, normally assume a closed configuration, as the outer gripping plates 56, 57 bear yieldably upon the fixed central plate 54.

Fixed to, or otherwise positioned to bear yieldably against the outer gripping plates 56, 57 are clip-forming plates 58, 59. In general, the clip-forming plates 58, 59 are movable with the outer gripping plates 56, 57, but are yieldably separable therefrom to receive the fabric material being processed, as will be further described. In the illustrated arrangement, the clip-forming plates 58, 59 are shown to be mounted directly to the base regions of the respective plates 56, 57. In one advantageous alternative, the clip-forming plates 58, 59 may be in the form of a continuous, spring-like member of U-shaped cross section, with the base of the U extending around the bases of the plates 56, 57. In the alternative arrangement, the U-shaped clip-forming element serves additionally as the means for resiliently urging the plates 56, 57 toward the fixed center plate 54.

Figure 14:
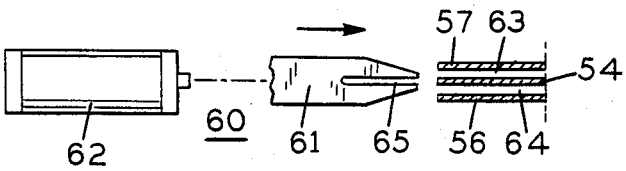
FIGS. 14, 15 are sequential schematic views of a mechanism for controllably opening gripping plates of the pleating apparatus to accommodate entry of the fabric material during the pleating operation.
Figure 15:
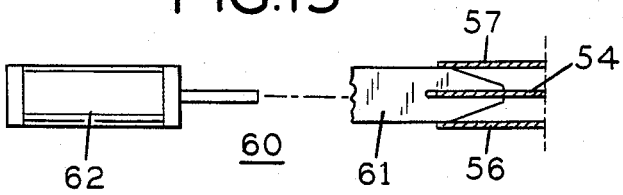

Mounted adjacent the uppermost pleat-forming position of the drum 50 is a plate spreading device 60 (see FIGS. 14, 15) comprising a slotted wedge 61 carried by a fluid actuator 62. The actuator and wedge are mounted generally parallel to the drum shaft 51 and, when the actuator is in its retracted condition, the wedge is positioned at the side of the drum. When the actuator is energized, the wedge is extended and enters the spaces 63, 64 defined between the fixed center plate 54 and the resiliently pivoted gripping plates 56, 57 on each side thereof. The center plate 54 is received in the slot 65 of the wedge, while the gripping plates 56, 67 are displaced to open positions, substantially as reflected in FIG. 15.

Figure 3:
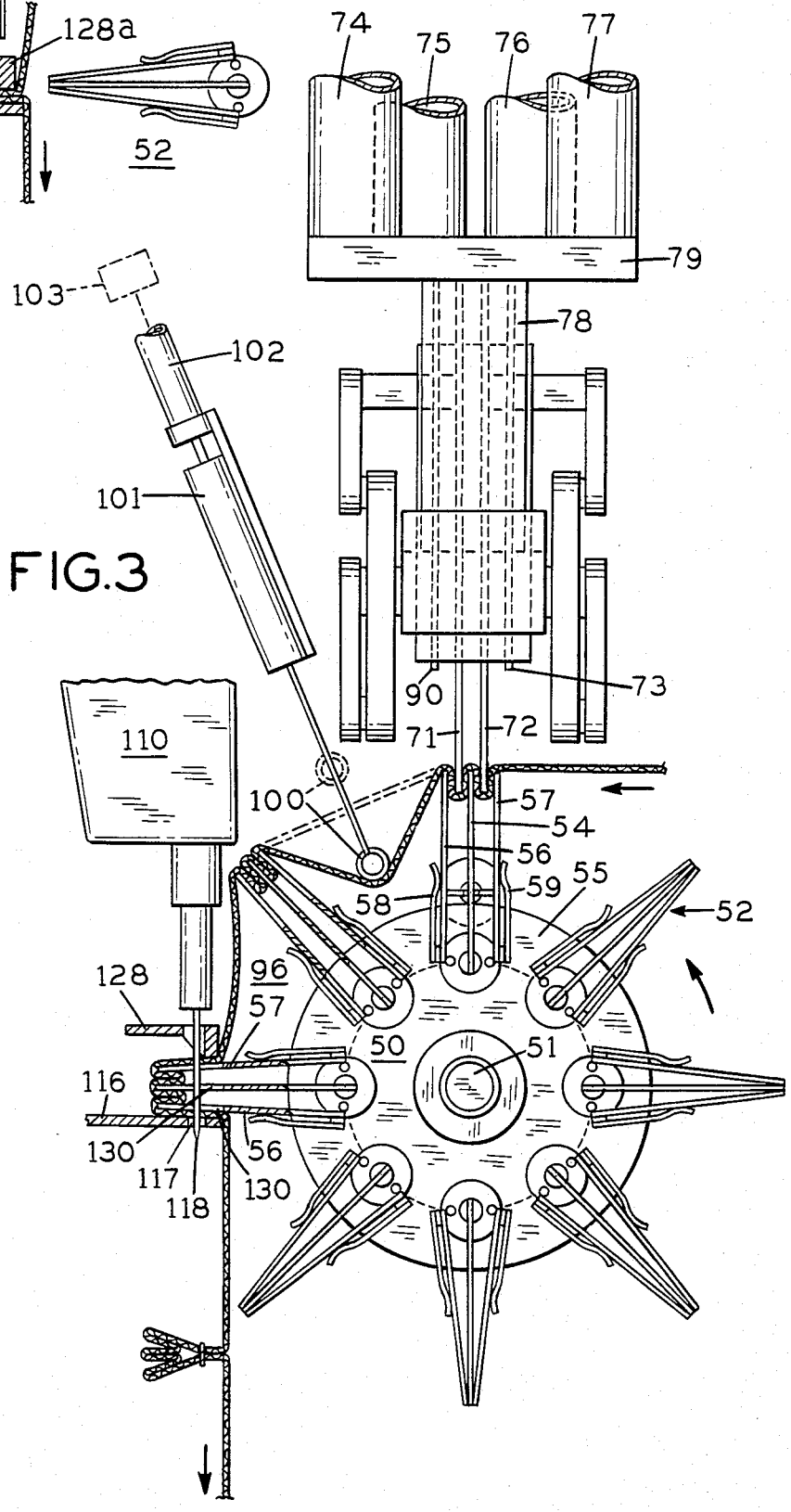
FIG. 3 is an enlarged, fragmentary illustration of a pleat-forming mechanism incorporated in the apparatus of FIG. 1.

As shown in FIG. 3, there is mounted directly above the uppermost pleat-forming position of the drum a group of four tongue plates 70, 73, which are projectable by fluid actuators 74–77 toward and away from the drum 50. The two inside tongue plates 71, 72 are the primary pleat-forming plates, while the outer plates 70, 73 function at the beginning and end respectively of the pleat-forming operations, in order to engage and retain the respective leading and trailing end runs, as will appear. The several tongue plates 70–73 are mounted in a guide block assembly 78 (FIG. 3), and the several actuators 74–77 therefore are mounted on a platform 79. In the illustrated arrangement, the two primary pleat-forming tongue plates 71, 72, sometimes referred to as sizing plates, are connected directly to actuators 75, 76. The outer tongue plates 70, 73, on the other hand, are more advantageously driven by the actuator 74, 77 through links 81 and levers 82 (see FIG. 18). The particular mechanical arrangements for this purpose are not of great consequence. To particular advantage, however, the actuation of the sizing plates 71, 72 should be of easily adjustable stroke, in order to accommodate variation in the depth of the eventual pleat folds. To this end, the mechanism includes a gauge block 83, which is supported above the main actuator mounting platform by means of spacer rods 84. The gauge block 83 is slideably movable within a guide member 85 and is secured in any adjusted position by means of bolts 86. As shown in FIG. 19, the gauge block 83 is provided with slots 87, 88 for the reception of gauge rods 89 projecting upwardly from the respective actuating cylinders 75, 76. The rods 89 carry stop bars 90, arranged to cooperate with the various stepped shoulders 91 of the gauge block. By slideably adjusting the gauge block, the extendable length of the actuator 75, 76, and thus the depth of projection of the sizing plates, can be accurately controlled.

The forming of a series of pleats is illustrated schematically in FIGS. 8–13. Initially, the fabric section, which has been processed in earlier operations to provide hems along the side and bottom edges and to attach the buckram stiffening strip 31 along the top edge, is loaded by the operator into the conveyor system, by initially symmetrically positioning the fabric section in relation to the calibrations 38, and detecting the location of either or both of the side edges 93, 94 (FIG. 2). The distance between pleats and the length of the respective leading and trailing end runs can be readily determined. This can be performed automatically by logic circuitry of known type, which can be provided for controlling the functions of the machine.

Either automatically (typical) or by manual control, the conveyor 12 is actuated to advance the fabric through the delivery section 21 and to project the leading end of the fabric over the top of the uppermost pleat-forming station of the drum 50. This is reflected in FIGS. 9 and 10, in the latter of which the pleat-forming gripping plates 56, 57 are illustrated in the open position, effected by actuation of the slotted wedge element 61 previously described. When the leading end of the fabric is positioned over the pleat-forming station, the pleat-forming tongue 70 is actuated downwardly in a manner to displace the fabric leading end 95 downward and cause it to be tucked between the clip-forming plate 58 and the adjacent gripping plate 56, all as shown in FIG. 11. This first operation is not a pleat folding operation, but merely serves to cause the leading end run of the fabric to be gripped by the mechanism, to enable the pleat hem to be sewed along the end edge to secure the folded-over buckram and to close the hem at the edge.

After the tongue plate 70 has been fully extended, the adjacent sizing plate 71, this one being a primary pleat-forming plate, is projected downward into the space between the center pleat-forming plate 54 and the adjacent gripping plate 56. The amount of projection of the sizing plate 71 is controlled by the stepped gauge plate 83, as previously described, to determine the depth of the pleat fold. After the first pleat fold has been completed, the adjacent tongue plate 72 is extended, to form the second pleat fold, as shown in FIG. 11. In this respect, it will be understood that the sizing plates 71, 72 are extended in the sequence described, such that fabric may be drawn from the conveyor side of the drum, to provide sufficient fabric to form the pleat folds. After gripping of the leading end run, and forming of the first pleat fold, as shown in FIG. 11, the slotted wedge 61 is withdrawn, by retraction of its fluid actuator 62, and the sizing plates 71, 72 are retracted, causing the respective gripping plates 56, 57 to converge upon the center plate 54, such that the pleat is resiliently gripped by the three plates. The drum 50 is then indexed to bring the next set of pleat-forming plates into the uppermost position. The just-formed pleat, gripped in its pleat-forming plates, moves to a neutral position, as indicated at 96 in FIG. 3, where it remains during the next successive pleat-forming sequence.

During the second and subsequent intermediate pleat-forming operations, neither the leading nor the trailing end run of the fabric is involved, and the pleat-forming operation requires only the actuation of the two primary sizing plates 71, 72, as reflected in FIG. 3, it being again understood that the plates will be projected in sequence, first the plate 71 and then the plate 72, to allow the fabric to be drawn from the right-hand side.

A convenient and advantageous means for controlling the spacing between adjacent pleats, is illustrated in FIG. 3. The illustrated arrangement includes a displacement bar 100, which is carried by a guide member 101 for generally radial inward/outward movement relative to the drum 50 and which is controlled by a fluid actuator 102. The fluid actuator in turn is provided with a mechanism, schematically indicated at 103, in the nature of the adjustable gauge block arrangement shown in FIGS. 19 and 20, such that the projection of the displacement bar 100 may be accurately controlled.

As reflected in FIG. 3, in broken lines, when the drum 50 is indexed in a clockwise direction, after a pleat-forming operation, the fabric is drawn with it, in more or less of a straight path between the idle position 96 and the active pleat-forming position. In this respect, the straight line distance between the outer ends of adjacent pleat-forming stations 52 is, by design, not greater than the minimum distance between pleats under any normal circumstances, and typically may be somewhat less than that. An adjustably controlled pleat spacing is provided, however, by radially inward displacement of the fabric between pleat-forming stations, prior to formation of a new pleat. Thus, as reflected in FIG. 3, when the drum is first indexed, the displacement bar 100 is in a retracted, dotted line position. After the indexing has been completed, the fluid actuator 102 is energized to extend a predetermined distance, as controlled by the gauge means 103. Typically, the gauge means 103 is adjusted for a given nominal width of fabric section, and any minor variations in that width are absorbed in the length of the respective end runs.

As reflected in FIG. 3, after formation of the pleat folds in the vertical or upright station of the drum 50, and the subsequent indexing thereof to the intermediate position 96, the next indexing movement of the drum brings a folded and gripped pleat to the sewing position which, in the illustrated structure, is a horizontal index position of the pleat gripping elements. In the case of the first-formed pleat fold of a given fabric section, it is desired to first form a short closure tack 104 (see FIG. 8) along the edge of the pleat hem. This both closes the end of the hem and secures the buckram strip 31 in its folded-over condition. As reflected in FIG. 11, when the end run of the fabric is tucked into the clip forming plate 58, an end extremity of the fabric projects radially beyond the end extremities of the several pleat forming gripping plates 54, 56, 57. Accordingly, when the initial pleat, still gripped by the pleat-forming station 52, is indexed to the horizontal or sewing position, a margin of the end run, if it is the first pleat, projects beyond the end of the pleat-forming station, where it is easily accessible to the sewing machine.

It is contemplated by the present invention, that the end tack 104 will be accomplished while the pleat itself remains gripped in the pleat-forming drum 50, the sewing operation being accomplished by movement of the sewing machine itself relative to the then stationary fabric, as will hereinafter appear. Similarly, when the last pleat is formed in the fabric, the trailing end run 106 is tucked under the clip forming plate 59, by sequentially timed extension of the tongue plate 73, after extension of the sizing plates 71, 72. The plate 59 provides for temporary gripping and projection of the end extremity of the fabric for sewing of a hem tack at the trailing end, when the last pleat of the fabric section is indexed into the sewing position.

When the initial pleat fold, containing the leading end run, is advanced into the sewing position, still gripped by the respective plates 58, 56, 54 and 57 of the pleat-forming station, two sewing sequences take place. First, the short closing stitch 104 is formed down the edge of the pleat hem. Immediately thereafter, the formed pleat hem is gripped by the sewing machine and drawn off of the pleat-forming drum, being thereafter clamped by the sewing machine itself entirely free of the drum. The pleat itself is then sewed, by a line of stitching 107, just below the individual pleat folds, and a second line 108 extending from the base line stitch 107 outward at right angles forming an L-shaped tack stitch. In some cases, the desired stitch is an inverted "F", in which case a short stitch, parallel to the stitch line 108, is made between the stitch 108 and the upper edge of the pleat. This additional pleat, designated by the reference numeral 109 in FIG. 8, typically does not extend to the full width of the pleat structure 53. For the intermediate pleat sewing operations, the step of closing the end run is, of course, not involved. It is again performed, however, in conjunction with the last-formed pleat, as will be understood.

In the illustrated form of the invention, production is expedited by carrying out the sewing operations at a high rate of speed. This is facilitated by mounting of the sewing machine for controlled biaxial movement relative to the fabric, which is held stationary throughout the sewing operation. As reflected in FIG. 16, the sewing machine 110 is mounted on a primary motion platform 111, which is guided for movement transversely of the axis of the sewing machine, by means of guide rods 112. The guide rods 112 are mounted on a secondary motion platform 113, which in turn is mounted on guide rods 114 for movement parallel to the axis of the sewing machine. The guide rods 114 are mounted to the sixth frame structure of the equipment, indicated schematically in FIG. 16 by the reference numeral 115. Any suitable means may be employed for driving the motion carriages 111, 113. A simple, yet highly effective arrangement is provided by engaging the respective motion carriages with controlled-rate fluid actuators (not shown). Typically, these may be in the form of air actuators provided with hydraulic systems for controlling the rate of motion. It is contemplated that the sewing machine 10 will be in continuous motion during the stitching operations, without pausing or decelerating during the needle strokes. Advantageous arrangements, to be described, are provided for accommodating limited movement of the fabric, with the moving needle, during the penetration of the fabric by the needle, to avoid excessive distortion of the fabric and/or the sewing needle. The average position of the fabric does not, however, change during the sewing operation.

In the apparatus of the invention, the sewing machine 110 may be of conventional high speed industrial design, having a throat plate 116 (FIG. 3) for supporting the fabric during sewing. The throat plate is provided with an opening 117 to receive the needle 118 in a known manner. Desirably, the sewing machine is of a lock stitch type, provided with the usual bobbin facility (not shown) below the throat plate.

Pursuant to the invention, the pleated fabric is held on the throat plate 116 by means of a novel clamping assembly, illustrated in detail in FIGS. 17 and 23–27 inclusive. The clamp means includes a clamping frame 120 (FIG. 17), pivotally mounted at 121 by means of a pair of swing arms 122. The latter are pivoted at 123 to the machine structure 115 for controlled movement by means of a pair of fluid actuators 124, 125. The actuators are connected in series, with one of them providing for limited forward-rearward motion for engagement of the clamp with an end run of the fabric panel and the other providing additional movement, for engagement of the fabric on the pleat-forming drum and withdrawal of the fabric to a sewing position, as will be described. Clamping movements (up and down) of the clamping frame 120 are effected by a lever 126, under the control of a fluid actuator 127 connected to the swing arms 122.

In accordance with one aspect of the invention, during the sewing operations involved in securing the end runs and pleats, the sewing machine, and not the fabric is in motion. This is accommodated by engagement of the fabric by means of a clamp 128 (see FIG. 4) which contacts the fabric over the throat plate 116. The clamping bar 128 is designed to provide a more positive grip on the fabric than the throat plate 116, which is provided with a highly polished top surface. Thus, during the sewing operations, the entire sewing machine, including the throat plate 116 are in motion relative to the fabric and to the clamping bar 128 as the desired stitch pattern is performed.

For the sewing of the end run, the sewing machine is advanced, along with the swing arms 122 and the clamping frame 120, to a position adjacent to the ends of the pleat-forming station which is then opposite the sewing machine. As reflected in FIG. 13, for example, the end run projects radially beyond the end of the pleat-forming station, which still holds the pleats, and is in position to be gripped between the clamping bar 128 and the throat plate 116. If necessary or appropriate, the projecting end run of the fabric may be manipulated by air jets (not shown) as the sewing machine and clamp approach. During the approach, the clamp is of course opened, by retraction of the actuator 127. When the end run is in proper position, the clamp is closed and sewing proceeds.

To effect sewing of the pleat itself, it is necessary first to remove the formed pleat from the gripping plates. To this end, the clamping frame is opened, and the sewing machine and clamp are advanced to a position as shown in FIG. 3, in which the throat plate 116 underlies the lower gripping plate 56 and the clamping bar 128 overlies the upper gripping plate 57. At this juncture, two control functions are initiated: First, the clamp is closed by energizing the actuator 127; second, the sewing machine itself is driven through a half needle storke, causing the needle 118 to penetrate through the fabric in the manner shown in FIG. 3. For this purpose, the several plates of the pleat-forming stations 52 are provided with open ended slots 130, which allow the sewing machine and clamp mechanism to be retracted, with the fabric being not only clamped between the throat plate 116 and clamping bar 128, but positively engaged by the through projection of the needle 118. As the machine retracts, it draws the formed pleat off of the gripping plates. When the fabric leaves the gripping plates, the clamping bar 128, under the pressure of the actuator 127, moves downwardly to firmly grip the fabric in the manner of FIG. 4, sufficiently beyond the end of the pleat-forming station 52 to accommodate indexing of the drum during a sewing operation.

The clamping frame 120 is illustrated in more detail in FIGS. 23–26 and constitutes one of the features of novelty of the invention. The frame 120 includes a generally U-shaped support frame 131, which resiliently mounts the clamping bar 128 for limited motion in a horizontal plane. The clamping bar 128 is of a configuration to provide a generally F-shaped slot 132, which is open at one end 133 to admit entry of the sewing needle 118.

Pursuant to the invention, the fabric to be sewn is gripped by the clamping frame 120 and held substantially stationary during the sewing operation, which is carried out by movement of the sewing machine itself, rather than movement of the fabric as is more conventional. However, since the sewing machine desirably is in constant motion, there tends to be limited relative movement between the needle 118 and the fabric, during those portions of the sewing cycles when the needle 118 has penetrated the fabric and is moving horizontally with the sewing machine. To accommodate such tendency for relative movement, without damaging the needle or the fabric, the clamping bar 128 is mounted for movement of at least one stitch width in any direction. Accordingly, while during the intervals when the needle has penetrated the fabric, both the fabric and the clamping bar 128 move with the needle and sewing machine. When the needle is withdrawn, the clamping bar 128 returns to its normal or neutral position relative to the U-shaped support frame 131.

In the illustrated arrangement, the clamping bar 128 is mounted by means of four elongated leaf spring elements 134, oriented to lie in vertical planes. The leaf springs 134 are mounted, cantilever fashion, in blocks 135 fixed to the end of the clamping bar 128. The free ends of the leaf springs are received in recesses 136 provided in the outer arms 137 of the U-shaped support frame 131.

To advantage, the leaf springs 134 are guided in slots 138 for limited lateral movement relative to the U-shaped support frame 131 and are restrained against upward movement relative to the support frame by means of antifriction rollers 139. The arrangement is such that even when downward pressure is applied to the leaf springs 124 by the U-shaped support 131, lateral movement of the clamping bar 128 is possible because of the low friction characteristics of the rollers 139. Coil springs 140 are positioned between the blocks 135, at opposite ends of the clamping bar, and the arms 137 of the support frame 131. These springs sever normally to maintain the clamping bar symmetrically positioned in the center of the support frame 131, while accommodating limited lateral movement of the clamping bar in either direction.

Front to back movement of the clamping bar 128, relative to its support frame 131, is accommodated by the inherent flexibility in that direction of the vertically oriented flat leaf springs 134.

FIGS. 25 and 26 are sequential schematic views showing the novel clamping bar arrangement as it functions in the course of a single stitching operation. In FIG. 25, the clamping bar 128 is shown as pressed tightly downward against the fabric 141, which may consist of several layers. The clamping bar compresses the fabric 141 against the throat plate 116. Desirably, the clamping bar 128 is contoured, to provide a heavier front bar section 128*a*, and a considerably thinner central or rear section 128*b*. This configuration, shown in FIG. 4, accommodates the fact that, in the area of the pleat proper, there are more layers of fabric to be accommodated under the clamping bar, than in the front extremity. A plurality of short pins or the like 142 project from the bottom of the clamping bar 128 into the fabric, to provide relatively positive gripping action between the clamping bar and the fabric.

As the sewing operation proceeds, the sewing machine (not shown in FIGS. 25, 26), throat plate 116 and needle 118 are all moving laterally relative to the substantially stationary fabric 142 and clamping bar 128. In the illustrated example, the motion is from left to right, although it will be understood that the motion may be in any horizontal direction. During each stitching operation, the needle 118 penetrates the fabric and passes through the opening 117 in the throat plate. While the needle is thus penetrating the fabric and moving laterally, the fabric and clamping plate are permitted to move along with it, against the action of the centering compression springs 140, and/or the front to back centering action of the leaf springs 134. For example, with the needle moving from left to right, as shown in FIG. 25, the fabric and the clamping bar 128 momentarily move with the needle 118. The U-shaped supporting frame 131 of course remains stationary, so that the right-hand coil spring 140 is compressed, while the left-hand springs are somewhat relieved. When the needle is withdrawn, the displacing forces acting on the fabric and clamping bar 128 are relieved, and the springs 140 (and/or the leaf springs 134 in the case of front to back displacement) return the clamping bar to its neutral position. In the meantime, the sewing machine is progressing at a uniform rate of speed, and the underlying throat plate 116 along with it. As reflected in FIGS. 25, 26, for example, the spacing "delta S" reflects the distance travelled by the needle during each stitch, whereas the distance "delta C" represents the somewhat lesser distance travelled by the clamping bar 128 in accommodating the movement of the needle. The "delta S" distance is necessarily somewhat greater than the "delta C" distance, inasmuch as the needle is during at least part of the stitching cycle totally withdrawn from the fabric.

The above described arrangement for clamping of the fabric in a substantially fixed position, while accommodating less-than-stitch width displacement of the fabric and its clamp during each stitching cycle, enables high speed sewing to be achieved with a great degree of efficiency. By allowing the fabric to remain essentially stationary, the matter of fabric handling and holding is greatly simplified. Additionally, by permitting the sewing machine to be bodily moved at a constant rate of speed, rather than intermittendly, a smoother, faster, quiter, more maintenance free operation is assured. All of these are important, desirable attributes of any industrial operation, as will be readily appreciated.

In the illustrated arrangement, the entire sewing operation, be it an L tack or an F tack, is accomplished through manipulations of the sewing machine. After sewing is completed, the clamping bar 128 is lifted, by retraction of the actuator 127, to free the fabric. Since the fabric may tend to adhere to the pins 142, it may be desirable and advantageous to provide one or more small air actuated plungers 143, positioned on the clamping bar 128. At the end of the sewing operation, the plungers 143 are actuated momentarily, to positively dislodge the fabric from the bottom of the clamping bar and free it for continued operations. At this point in the cycle, the drum 50 is indexed, to bring a new folded pleat into sewing position, and the just described cycle of operations is repeated.

When the end of the drapery section reaches the sewing station, the sewing sequence includes the sewing of the pleat in the normal fashion, followed by repositioning of the clamp without indexing of the drum and closing of the pleating hem adjacent the extremity of the end run.

As will be appreciated, pleat-forming operations at the upper pleat-forming station may be carried out simultaneously with the sewing operations occurring at the horizontally oriented station, providing for optimum efficiency in the overall operation. During successive indexing movements of the pleat-forming drum 50, the primary conveyor 12 is advanced correspondingly, a sufficient distance to accommodate the spacing between pleats and also the amount of fabric utilized in the forming of the pleat folds themselves. Movement of the upper or secondary conveyor 13 advantageously follows a related but slightly different motion sequence, taking into account the fact that the fabric, after forming of the pleat folds at the drum 50, is discharged from the drum and simply falls downward from the sewing machine.

As will be readily understood, it is not necessary for the lower edge of the drapery section (engaged by the upper conveyor 13) to be synchronous with the pleated edge of the fabric, as there is ample fabric flexibility to accommodate differential motion. In an advantageous system according to the invention, the secondary or upper conveyor 13 may move in half steps, for example. Thus, when the pleat hem begins to be advanced into the pleat-forming drum, the upper conveyor may be advanced halfway to the delivery position. It may remain in this position while the several pleat-forming and sewing operations take place. When the last sewing operation has been completed, the upper conveyor may advance a half step further to the unload position.

In the arrangement of the invention, after the last pleat and end run have been sewn, and the fabric released by the sewing clamp, the entire upper or pleated edge of the fabric will drop free, and the finished fabric section is suspended upside down from the upper conveyor 13, in a location adjacent the pleat-forming drum. To advantage, a suitable rack, for example, a rack similar to that shown at 10 in FIG. 1, may be provided adjacent the sewing station, to receive sections of the finished fabric. In this respect, the fabric is easily released from the upper conveyor 13, by simply lifting upwardly on the inner ends of the fabric clamping levers 47 as the pleated edge of the fabric falls free of the sewing machine after completion of the last sewing operation.

The method and apparatus according to the invention enable outstanding efficiencies to be realized in the production of pleated fabrics. Under conventional methods, a typical sustained production of an operator may be on the order of ninety pieces per hour, and performance of the work requires a rather skilled operator. With the equipment of the invention, on the other hand, a given machine is capable of production rates of two to three panels per minute, and a single, relatively unskilled operator, easily can handle the loading and unloading operations involved in the operation of two machines. Thus, a single operator may be responsible for production rates on the order of 240–360 panels per hour. At the same time, quality of the product is enhanced because of the uniformity and symmetry achieved in the production operations.

The pleat-forming mechanisms utilized in the system of the invention are highly efficient, providing for accurate pleat formation, accurate and adjustable spacing between pleats, and effective manipulation and transportation of the folded pleats prior to sewing.

The sewing operation itself is carried out in a highly advantageous manner by permitting the fabric to be held essentially stationary during the sewing operations and causing the sewing machine itself to be manipulated to form the desired L tack or F tack on the folded pleat. Efficiency of the sewing operation is enhanced by providing for continuous motion of the sewing machine while providing limited (single stitch width) intermittent motion of the fabric during intervals of the sewing cycle when the sewing needle has penetrated the fabric. A special clamping device, intended primarily to hold the fabric stationary during sewing operations, is constructed to provide limited, resiliently resisted motion of the clamping bar as necessary to avoid undue stress and deflection on the sewing needle. As soon as the needle has been retracted, the clamping bar and fabric return to a neutral position relative to the otherwise stationary clamping mechanism.

The system of the invention also includes advantageous conveyor means for handling the fabric throughout the pleat-forming and sewing operations. In particular, the infeed conveyor for the pleat hem is designed to engage and confine the pleat hem for accurate orientation and feeding. Moreover, in this respect, the infeed conveyor is designed to expedite loading of the fabric panel and symmetrical positioning of the panel so as to assure symmetry of the pleat formations relative to the side edges of the panel.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. The method of making pleated drapes or the like, in which a fabric panel is advanced widthwise, gathered periodically into multiple fold pleats along the top edge and secured at the pleat folds, the improvement which comprises (a) advancing the top edge of the fabric widthwise in a controlled manner, (b) forming a set of pleat folds in said top edge and gripping the folds, (c) while continuing to grip said folds, incrementally advancing the fabric top edge to bring the next pleat fold region into pleat-forming position, (d) while continuing to grip the previously formed pleat folds. controllably displacing the fabric in the region between the gripped pleat folds and the pleat forming position, to establish a predetermined spacing between adjacent pleats, (e) forming a next set of pleat folds while continuing to grip the previous set and while maintaining the fabric controllably displaced, and gripping said last formed set of folds, (f) while continuing to grip the beforementioned sets of pleat folds, incrementally advancing said fabric to bring said previously formed set of pleat folds into sewing position, and (g) sewing said previously formed set of pleat folds.

2. The method of claim 1, further characterized by (a) said pleat folds are gripped, prior to sewing, by the pleat forming means, (b) the pleat folds at the sewing station being grippingly engaged by separate sewing clamp means and withdrawn from the pleat-forming means prior to sewing.

3. The method of claim 2, further characterized by (a) the fabric engaged by the sewing clamp means being pentrated by a sewing needle during withdrawal from the pleat-forming means.

4. The method of making pleated drapes or the like, in which a fabric panel is advanced widthwise, gathered periodically into fold pleats along the top edge and secured at the pleat folds by a sewing machine, the improvement which comprises (a) advancing the top edge of the fabric widthwise in a controlled manner, (b) forming a set of pleat folds in said top edge and gripping the folds, (c) while continuing to grip said folds, incrementally advancing the fabric top edge to bring said folds into a position adjacent the sewing machine, and (d) extracting said pleat folds and relocating them at a sewing position by grippingly engaging said pleat folds with the sewing machine and moving said sewing machine.

5. The method of making pleated fabrics, which comprises (a) advancing a fabric panel, (b) forming successive pleats in said panel.

(c) gripping successive ones of said pleats and actuating a sewing machine to perform a sewing operation to receive said pleat, (d) during said sewing operation maintaining said sewing machine in substantially non-intermittent motion while maintaining said pleat substantially motionless (e) said pleat being gripped during sewing thereof in a manner accommodating limited lateral motion of the pleat with the sewing needle during times when the needle penetrates the fabric, and (f) causing or permitting the pleat to return to a predetermined position for the next stitch during times when the needle is withdrawn from the fabric.

* * * * *